US005149041A

United States Patent [19]

Hartke

[11] Patent Number: 5,149,041

[45] Date of Patent: Sep. 22, 1992

[54] PORTABLE HOLDER TO SUPPORT A RECAPPED CONTAINER OF EFFERVESCENT LIQUID IN AN INVERTED POSITION TO RETAIN THE LIQUIDS FRESHNESS

[76] Inventor: Dennis V. Hartke, 4825 Mill Pond Loop, Auburn, Wash. 98002

[21] Appl. No.: 748,184

[22] Filed: Aug. 21, 1991

Related U.S. Application Data

[63] Continuation-in-part of Ser. No. 461,683, Jan. 8, 1990, Pat. No. 5,065,966, which is a continuation-in-part of Ser. No. 277,360, Nov. 29, 1988, Pat. No. 4,960,254.

[51] Int. Cl.[5] ..... A47G 23/02

[52] U.S. Cl. ..... 248/146; 248/311.3; 211/74

[58] Field of Search ..... 206/201, 203, 427, 446, 206/151, 147, 158; 215/1 C, 12 R; D6/462, 466, 449; D7/70; 220/514, 513, 509; 248/146, 311.3; 211/74

[56] References Cited

U.S. PATENT DOCUMENTS 1,672,033 6/1928 Mallins ..... 248/146 X
2,574,270 11/1951 Leonard .
2,780,081 2/1957 Alexander .
4,960,254 10/1990 Hartke ..... 211/74 X
5,065,966 11/1991 Hartke ..... 211/74 X

*Primary Examiner*—Blair M. Johnson

[57] ABSTRACT

A holder in various embodiments, holds a previously opened, now recapped, bottle partially filled with an effervescent liquid, in an inverted position, wherein the effervescent liquid forms a seal about the interior of the replaced cap, to prevent the escapement of effervescent gasses. The holder can also be used in the storage, display, and transporting of unopened containers in a non-inverted position due to the congruent positioning of the vertical supports used to stabilize the containers in the inverted position.

The vertical supports that stabilize the container in the inverted position are sized and congruently positioned about the holder to allow the containers therein, to be vertically stacked for storage, display, or transporting, wherein, the column strength for supporting the upper tier of containers, and holders, is supplied by the containers in the lower tier, and not by the vertical supports, used for stabilizing the containers in the inverted position.

6 Claims, 5 Drawing Sheets

VIEW-A-A

PORTABLE HOLDER TO SUPPORT A RECAPPED CONTAINER OF EFFERVESCENT LIQUID IN AN INVERTED POSITION TO RETAIN THE LIQUIDS FRESHNESS

CROSS REFERENCE

This application is a continuation in part application, being filed while the application Ser. No. 07/461,683 filed Jan. 8, 1990, U.S. Pat. No. 5,065,966. Application Ser. No. 07/461,683 was a continuation in part of application Ser. No. 07/277,360 filed Nov. 29, 1988, U.S. Pat. No. 4,960,254.

All of these applications have the same title: A Portable Holder to Support a Recapped Container of Effervescent Liquid in an Inverted Position to Retain the Liquids Freshness, and Dennis V. Hartke is the applicant of all applications.

TECHNICAL FIELD

The invention relates to a container holder for storing resealed containers having effervescent liquid therein, in an inverted position to retain the freshness of the effervescent liquid, wherein the container does not limit or impede the stackability of the containers for transporting, or display purposes.

BACKGROUND ART

There have been many advances in the art of bottling, capping, and sealing of containers. There has not however ever been an effective method of resealing opened bottles having effervescent liquid therein, using the original cap.

Threaded caps are used extensively in the capping of containers having effervescent liquid inside, and are very effective on the first seal, however after the container is opened, the effervescent liquid therein begins to loose its "fizz" due to the escapement of gas. By replacing the cap, the escapement of gas is slowed but not stopped due to the continued escapement of gas past the now unsealed, but replaced cap.

Racks or container supports for supporting bottles are known in the art, most particularly for wine bottles. These racks or supports ordinarily support the bottle if sealed with a cork in a mostly horizontal position with the liquid therein in contact with the cork to insure that the cork remains moist, because a dried-out cork is difficult to remove and/or may crack during removal. However, in the past, if the bottle has been sealed with a threaded cap or a cap other than a cork, it is racked or supported in a manner that will prevent the liquid from coming in contact with the cap to prevent leakage. The shelf life of an opened then recapped container of effervescent liquid stored in this "prior art" position, is limited to hours, due to continued gas escapement.

The prior art devices for supporting containers in the mostly horizontal position are not suitable for supporting "state of the art" effervescent liquid containers because of their size and shape. There is also great emphasis in todays market for compactness, and the ability to develop easy, yet attractive product displays, and the ability to ship products without excessive packaging waste or hard to handle time consuming returnable packaging. None of these desired qualities are found in the prior art devices, designed for inverted container support. The prior art devices for inverted container supports were not designed for use in conventional refrigerators, or coolers.

SUMMARY

It is the object of the present invention to provide a means for storing recapped containers having effervescent liquid therein, in an inverted position to retain the beverages freshness, in conventional coolers or refrigerators. It is a further object of this invention to provide a means for stacking, transporting and/or otherwise displaying the container, while in the holder, in a non-inverted position, wherein, the column strength for supporting the upper tier of containers is provided by the containers in the lower tier, and does not rely on the vertical supports of the container holder to provide column stacking strength.

The invention is comprised of a container holder having vertical supports, a central top opening with a formed pocket for receiving the exterior of an inverted container. The container is lowered into the central top opening and formed pocket of the container holder. The container is stabilized in the inverted position by means of the formed pocket, and the vertical supports of the container holder.

There is also a species of container holders that have multiple openings with formed pockets for supporting multiple containers.

Container holders for supporting containers in the inverted position, for various reasons, has been known for many years. This method of storage has been used mostly for the storing of wine bottles having cork closures, or for supporting containers having viscous content, to allow the contents to drain into the containers opening. The container holders of this prior art do not address present day stacking, storage, marketing, transporting, and instore display requirements. I feel my device addresses these current needs, as well as the need to retain beverage freshness after opening and recapping of the container.

DRAWINGS

The various embodiments of container holders for supporting a previously opened effervescent liquid container, partially emptied and recapped, in an inverted position to retain the liquids freshness, are illustrated. There are also embodiments showing the stacking and stabilizing features of the holder illustrated in the drawings wherein.

Figure 1:
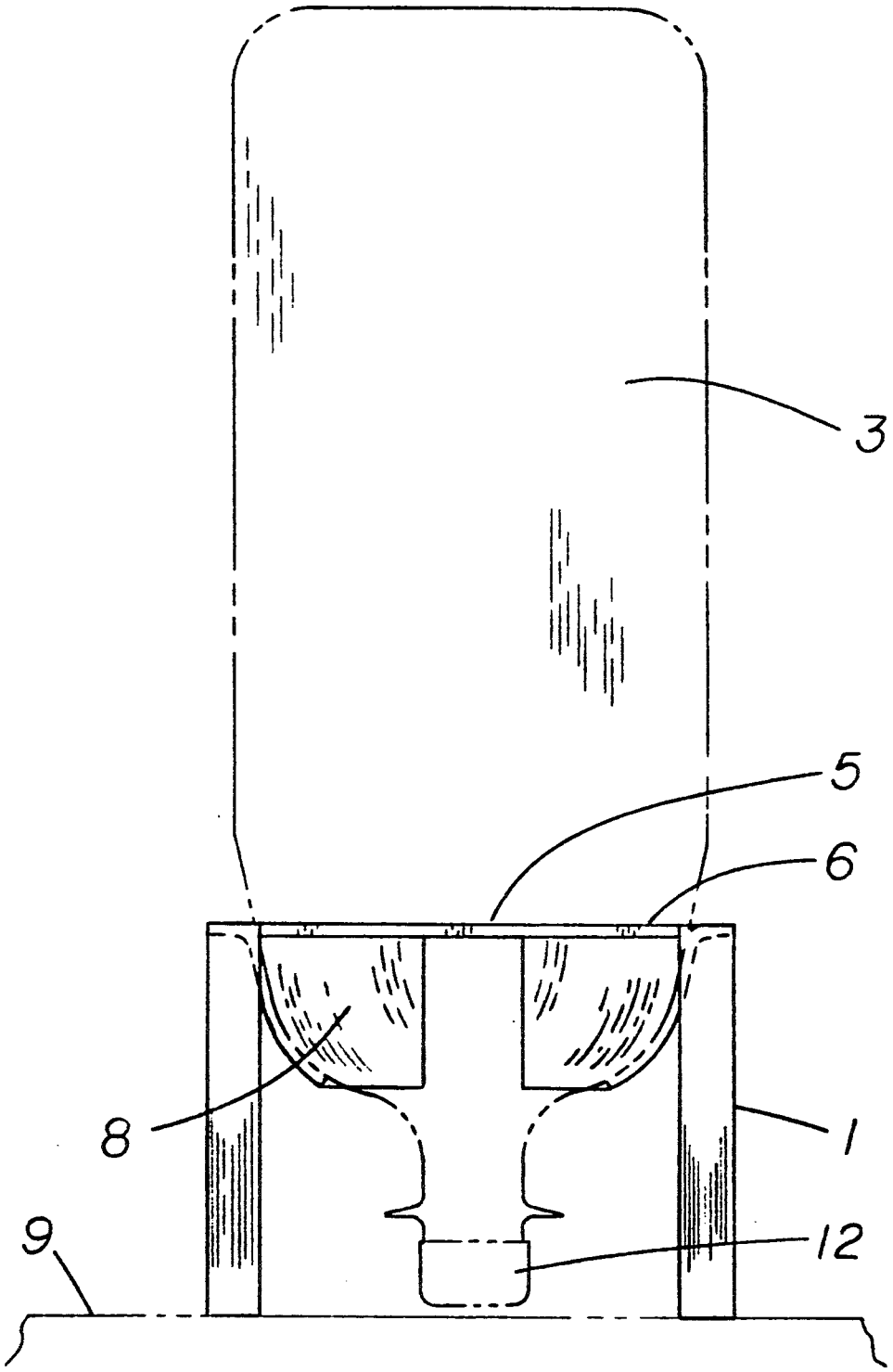
FIG. 1 is a front view of a species of a holder of the present invention, showing the holder as it would support an individual recapped bottle to preserve its freshness.
Figure 2:
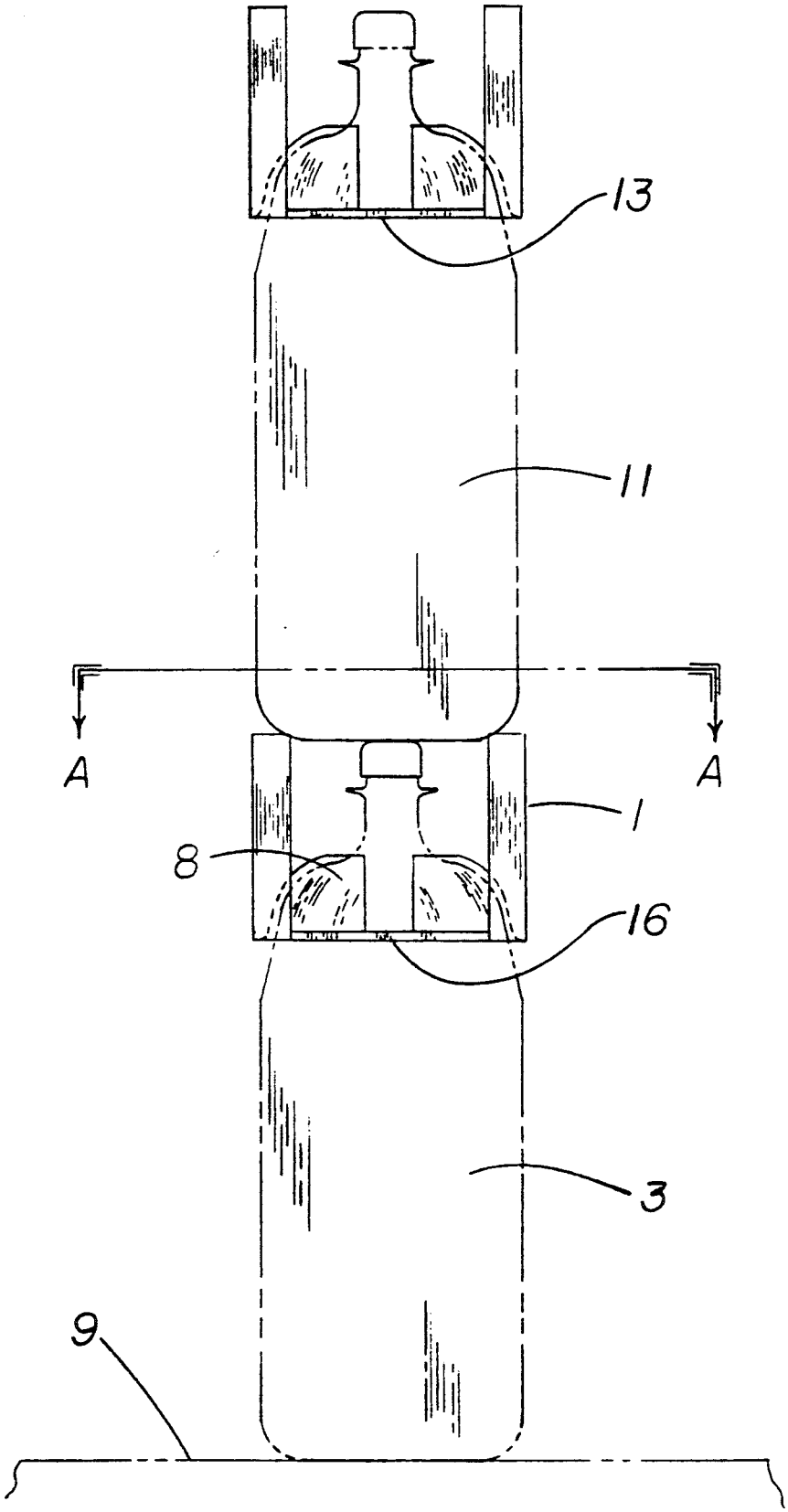
FIG. 2 is a front view of the same species of holder as FIG. 1 showing the stacking feature of the holder of the present invention.
Figure 3:
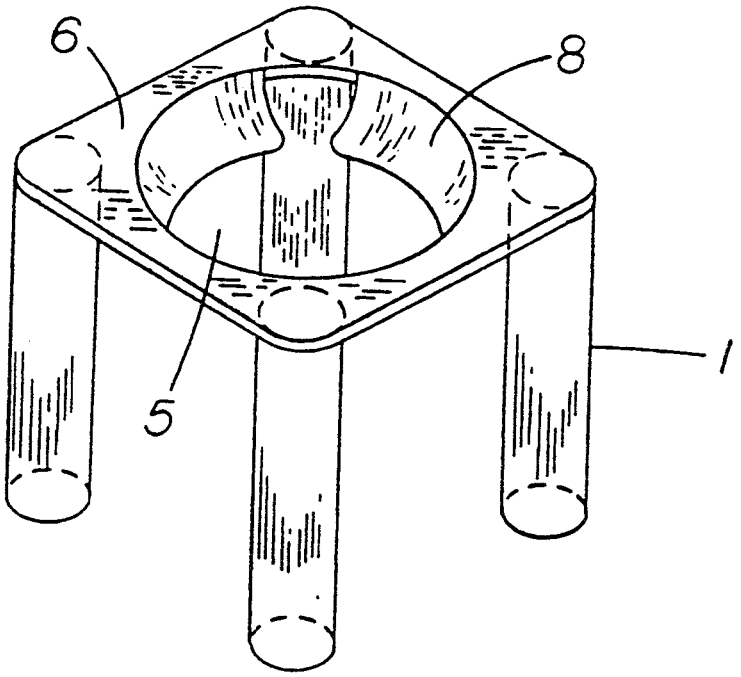
FIG. 3 is a perspective view of the same species of holder shown in FIGS. 1 and 2.
Figure 6:
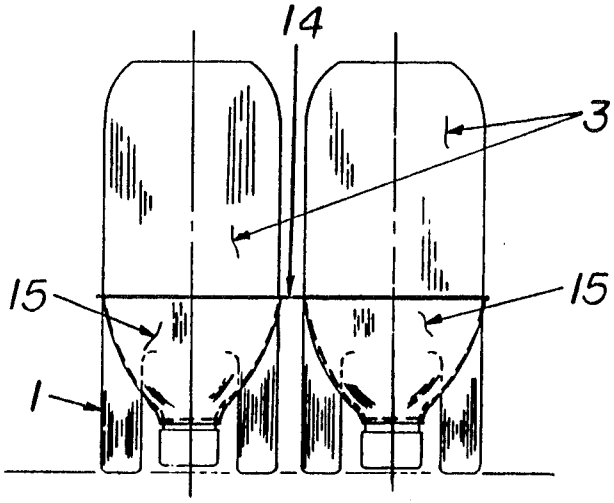
Figure 5:
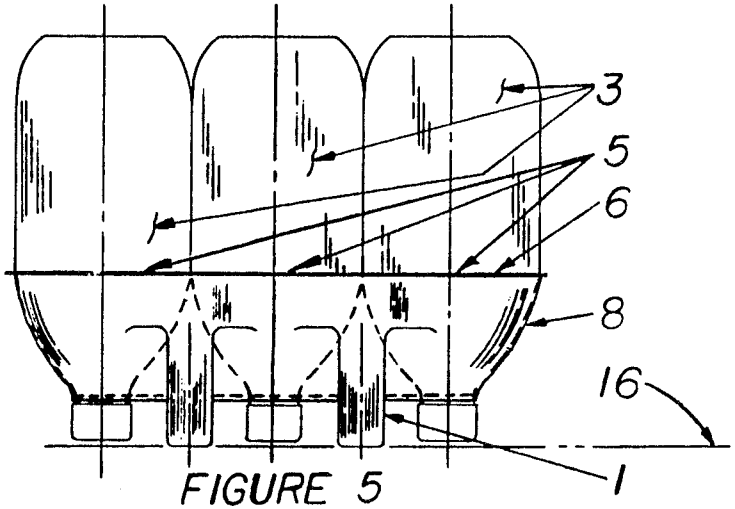
Figure 7:
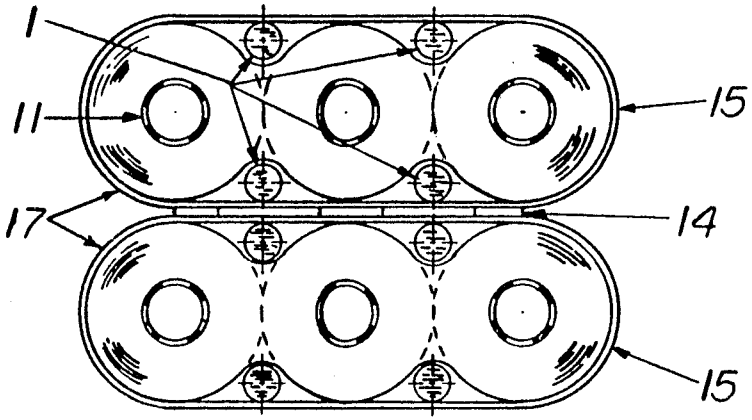

FIGS. 5, 6, and 7 show a front, end, and bottom view respectively of a holder of the same species as FIGS. 1, 2, and 3 supporting multiple containers in the inverted position.

Figure 9:
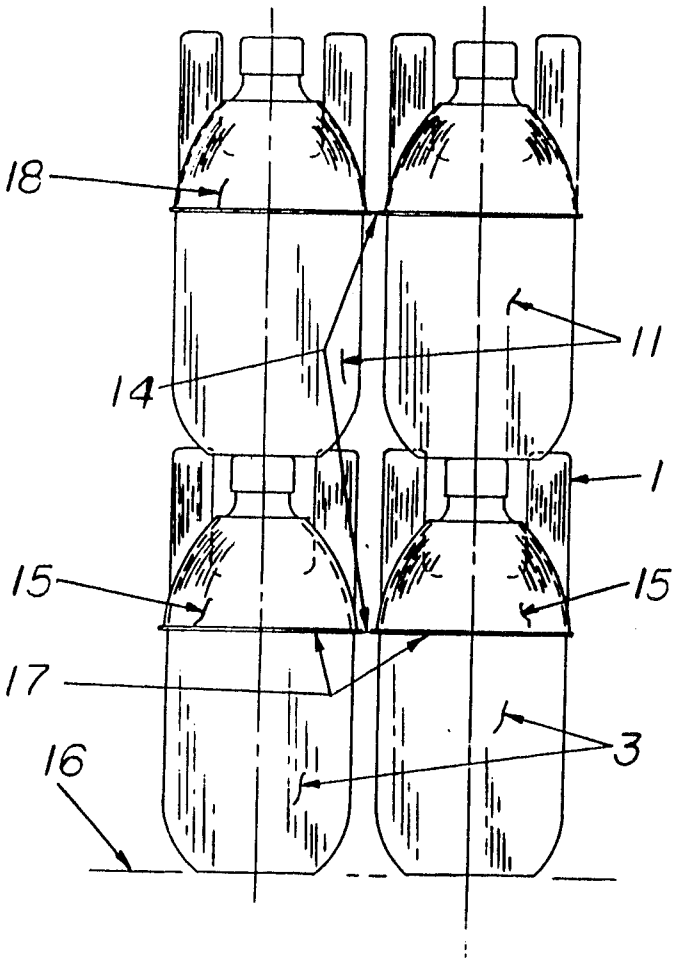
Figure 8:
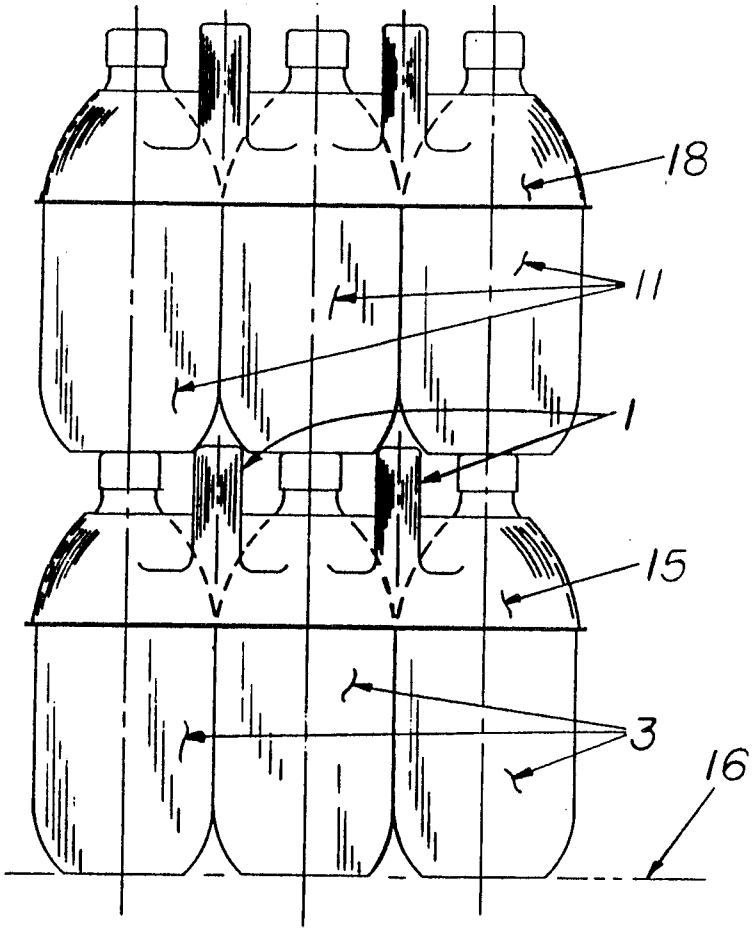

FIGS. 8, and 9 show front and end views respectively of the same multiple container holder, shown in FIGS. 5 through 7, illustrating its stacking features. It further illustrates the congruent positioning of the vertical supports, and how this allows the containers in the lower tier to supply the column strength for supporting the upper tier of containers when they are stacked in the upright position.

DESCRIPTION OF THE PREFERRED EMBODIMENT

The container holder of the present invention shown in FIG. 1 is comprised of vertical supports (1), a top portion (6), a central top opening (5), large enough to receive the exterior of an inverted container (3), and formed pocket (8). As shown in FIG. 1, the top portion (6), of the container holder has a top opening (5), and a formed pocket (8), for supporting the container (3), in the inverted position. The vertical supports (1), are positioned congruously about the container (3), and formed pocket (8), and are used to stabilize the holder. The length of the vertical supports (1) are at least equal to the farthest distance the inverted container (3) must protrude into the formed pocket (8) to become stable in the inverted position.

Figure 4:
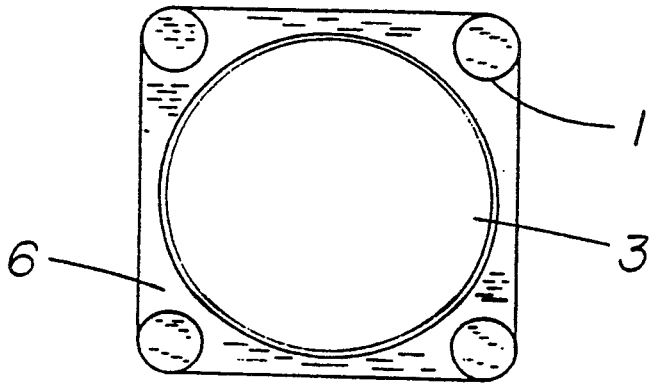
FIG. 4 is a section view through FIG. 2 illustrating the congrous locations of the vertical supports which allows for the stacking of containers, wherein, the vertical supports for supporting the container in the inverted positions are not used for column strength when containers are stacked in the upright position.

The upright stacking feature of this species of the present invention is illustrated in FIG. 2. The container (3) is placed in an upright position on base (9). The container holder (16) is placed on the lower container (3) with the formed pocket (8) of the container holder (16) positioned on the lower container (3), additional containers (11) can be stacked on top of the lower container (3). When containers (3) and (11) are stacked in the upright position, in this manner, the weight of the upper container (11) and holder (13) is supported completely by the lower container (3). The congruent positioning of the vertical supports (1) about the container (11) shown in FIGS. 1, 2, and 4, prevent the vertical supports (1) from supplying any of the column strength for supporting container (11) and holder (13) in the upper tier.

The species of holder of the present invention shown in FIGS. 5, 6, and 7, supports the inverted container (3) in the same manner as the holder in FIGS. 1, 2, and 3, and illustrates the ability to make container holders (15) capable of supporting multiple containers (3) in the inverted position. This multiple holder (15) is comprised of vertical supports (1), multiple formed pockets (8), multiple openings (5), and a top portion (6). The containers (3) are lowered through the top opening (5), and rests in the formed pockets (8), the vertical supports (1) stabilize the container holder (15) and the containers (3).

FIGS. 5, 6, and 7, also illustrates the ability for one or more container holders (15) to be connected together through the use of connecting tabs (14) to form a larger holder unit (17). The larger container holder unit (17) can also be separated into smaller container holders (15) by disconnecting them from the connecting tab (14).

FIGS. (8) and (9) illustrate the upright stacking features of the multiple unit container holder (15), and/or (17). The containers (3) are set in upright positions on a base (16). The holder (15) is then positioned on the containers (3), wherein the containers (3) rest in formed pocket (8). With the containers (3) positioned as described, additional containers (11) can be stacked on top of the lower containers (3), wherein the weight of the upper tier of containers (11) and holder (18) is supported completely by the containers (3) in the lower tier. The vertical supports (1) of the lower container holder (15) do not supply any column strength for supporting the upper tier of containers (11) or holder (18).

The congruent positioning of the vertical supports (1) about the formed pockets (8) prevent the vertical supports (1) of the holder (15) from supplying any of the column strength for supporting the upper tier of containers (11) and holders (18).

I claim:

1. A portable holder in combination with a previously opened, recapped container of effervescent liquid, upper portions of said container having arcuate surfaces, wherein, the container is supported in an inverted position, whereby, remaining effervescent liquid therein is forced into contact about the interior of the replaced cap causing the liquid to form a seal between the cap and container to prevent the escapement of gas from the container, comprising:

a surrounding upright body having a top portion, with a formed pocket therein which conforms to and engages said arcuate surfaces, and open bottom ended congruently spaced vertical support means, wherein, said formed pocket, in said top portion, receives, and limits the lateral movement of said inverted container, wherein, said vertical support means are congruously positioned about said formed pocket, and extend downward from said top portion a distance at least equal to the farthest distance the inverted container must protrude through said top portion to stabilize said container in an inverted position.

2. A portable holder as claimed in claim 1, wherein, the congruent positioning of said vertical support means allows additional containers to be stacked one on top of another in a vertical, non-inverted position, wherein, the container in an upper tier relies on the container in a lower tier for column support, and does not rely on said congruently positioned vertical support means of said holder to supply any of the column strength for supporting the upper tier.

3. A portable holder in combination with at least one previously opened, recapped container of effervescent liquid, upper portions of said at least one container having arcuate surfaces, wherein, the container is supported in an inverted position, whereby, remaining effervescent liquid therein is forced into contact about the interior of the replaced cap causing a liquid to form a seal between the cap and container to prevent the escapement of gas from the container, comprising:

a surrounding upright body having a top portion, with multiple formed pockets therein, and open bottom ended congruently positioned vertical support means, each of said formed pockets conforms to and engages a respective one of said at least one container, wherein, said formed pockets, in said top portion, receive and limit the lateral movement of a respective one of said at least one inverted container, wherein, said vertical support means are congruously positioned about said formed pocket, and extend downward from said top portion a distance at least equal to the farthest distance the inverted container must protrude through said top portion to stabilize said container in an inverted position.

4. A portable holder as claimed in claim 3, wherein, the congruent positioning of said vertical support means allows additional containers to be stacked one on top of another in a vertical, non-inverted position, wherein, the containers in an upper tier relies on the containers in a lower tier for column support, and does not rely on said congruently positioned vertical support means of said holder to supply any of the column strength for supporting the upper tier of containers, wherein, said portable holder is usable in combination with unopened containers for stacking during shiping, storage, and display.

5. A portable holder as claimed in claim 3, wherein, two or more portable holders can be connected together, thereby, forming a portable holder capable of supporting multiple containers.

6. A portable holder as claimed in claim 3, wherein, multiple portable holders may be separated to form individual portable holders capable of supporting fewer containers.

* * * * *